US005177909A

United States Patent [19]

Klocke

[11] Patent Number: 5,177,909

[45] Date of Patent: Jan. 12, 1993

[54] HAND-HELD SANDING DEVICE

[76] Inventor: Kenneth J. Klocke, 3002 A Flechtner Dr., Fargo, N. Dak. 58107

[21] Appl. No.: 597,385

[22] Filed: Oct. 15, 1990

[51] Int. Cl.[5] ..... B24D 17/00

[52] U.S. Cl. ..... 51/358; 51/370; 51/391

[58] Field of Search ..... 51/358, 390, 391, 392, 51/393, 382, 394, 370, 371

[56] References Cited

U.S. PATENT DOCUMENTS

| | | | |
|---|---|---|---|
| 2,103,320 | 12/1937 | Corff | 51/382 |
| 2,802,313 | 5/1957 | Bleam | 51/391 |
| 2,804,729 | 9/1957 | Dahlstrom | 51/391 |
| 2,808,687 | 10/1957 | Brown | 51/391 |
| 4,534,138 | 8/1985 | Pangburn | 51/382 |
| 4,688,356 | 8/1987 | Madzgalla | 51/391 |
| 4,937,910 | 7/1990 | Frazier | 51/391 |

FOREIGN PATENT DOCUMENTS

| | | | |
|---|---|---|---|
| 0257776 | 11/1986 | Japan | 51/394 |

*Primary Examiner*—M. Rachuba
*Attorney, Agent, or Firm*—Burd, Bartz & Gutenkauf

[57] ABSTRACT

A laterally flexible and generally longitudinally inflexible hand-held sanding device. The device includes a generally tubular thick walled body of tough rugged semi-rigid resilient material which is generally cylindrical through about three-fourths of its periphery. An angular extension projects from one side of the generally cylindrical body, defined by intersecting flat tangential faces. A longitudinal slit extends the length of the body bisecting the angular extension and, with the tangential faces defining a pair of closely spaced apart adjacent symmetrical parallel angularly and outwardly extending tapered lips. The sander may be flexed to accommodate a variety of contours to be sanded. It may be used in association with sheets of sandpaper or other abrasive material, or abrasive material may be embedded in the body of the sander, either at the surfaces thereof or throughout the body.

18 Claims, 1 Drawing Sheet

HAND-HELD SANDING DEVICE

BACKGROUND OF THE INVENTION

1. Field of the Invention

This invention is directed to a hand-held device for smoothing and/or polishing surfaces, such as painted or enameled surfaces. The sander may be used to hold sandpaper or other abrasive sheet material or abrasive material may be embedded in or coated on the surface of the sander. Although not so limited, the sander of this invention is primarily intended for use in sanding non-planar surfaces, such as are encountered in auto body repair and finishing work, and the like. Although equally useful for dry or wet sanding, the device in its preferred form is especially adapted for wet sanding.

2. The Prior Art

The sander of the present invention has evolved from the hand-held sanding device which is the subject of my co-pending application Ser. No. 401,814, filed Sep. 1, 1989. The sander of that application comprises a hollow generally tubular walled body of tough semi-rigid resilient material which is generally cylindrical in its normal relaxed at-rest state and has a longitudinal slot extending the length of the body and severing the body wall to facilitate lateral flexing of the body. A pair of spaced apart parallel angularly and inwardly extending tapered lips are on opposite sides of the slot. The sander body is adapted to engage the back surface of a sheet of sandpaper or other abrasive sheet material over at least a substantial portion of its outer face, or, alternatively, abrasive grit may be embedded in at least the outer face surface of the sander body or abrasive grit may be distributed substantially uniformly throughout the sander body.

SUMMARY OF THE INVENTION

The hand-held sanding device of the present invention is laterally flexible and relatively inflexible longitudinally. It comprises a hollow generally tubular thick walled body of tough semi-rigid resilient material, that body being generally cylindrical through about three-fourths of its periphery when the body is in its normal relaxed at-rest state. An angular extension projects from one side of the generally cylindrical body, defined by intersecting flat tangential faces. A narrow radial slit through the angular extension extends the length of the body and severs the body wall to facilitate lateral flexing of the body. The longitudinal slit bisects the angular extension and defines one edge of a pair of closely spaced apart parallel angularly outwardly extending symmetrical tapered lips on opposite sides of the slit. The sander body is adapted to engage the back surface of a sheet of sandpaper or other abrasive sheet material over its outer face, the free edges of the abrasive sheet material being receivable within the longitudinal slit. Alternatively, abrasive grit may be embedded in at least the exposed face surfaces of the sander body or abrasive grit may be distributed substantially uniformly throughout the sander body.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
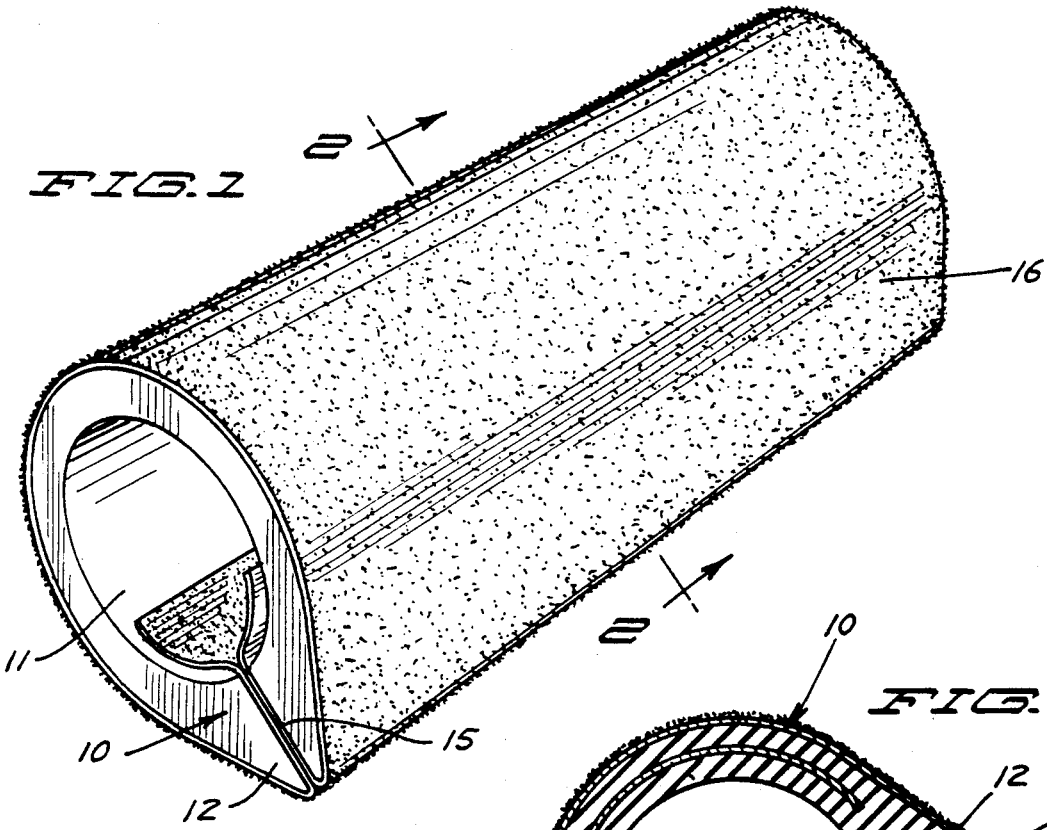
FIG. 1 is a perspective view of the hand-held sanding device shown in its normal relaxed at-rest state with sandpaper or other abrasive sheet material in engagement with the outer body face and extending through the longitudinal slit.
Figure 2:
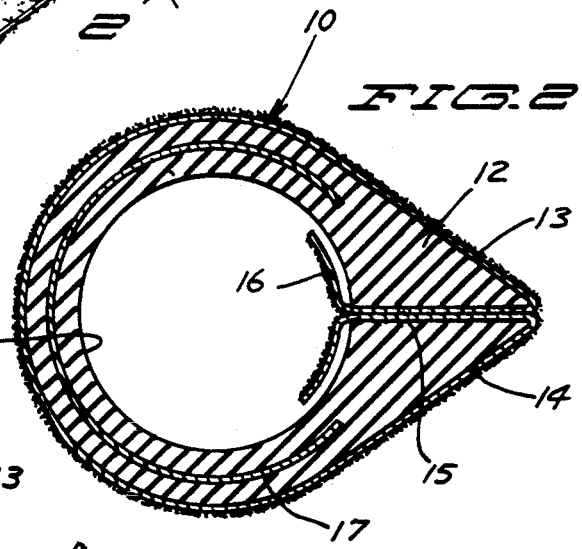
FIG. 2 is a section on the line 2—2 of FIG. 1 and in the direction of the arrows.
Figure 3:
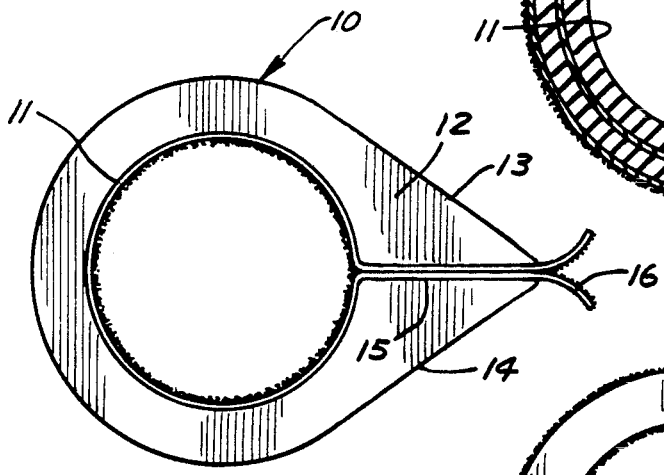
FIG. 3 is an end view of the hand-held sanding device shown in its normal relaxed at-rest state with sandpaper or other abrasive sheet material in engagement with the inner surface of the tubular body.

Referring now to the drawings, and particularly to FIGS. 1 through 3, there is shown one form of hand-held sanding device according to the present invention including a hollow generally tubular thick walled body, indicated generally at 10, shown in its normal relaxed at-rest state. Body 10 is generally cylindrical through about three-fourths of its periphery and has a longitudinal cylindrical passage 11 extending through its length. An angular extension 12 projects from one side of the generally cylindrical body 10. Angular extension 12 is defined in part by a pair of intersecting flat faces 13 and 14 which are tangential to the cylindrical portion of the body. In cross section, as shown, the sander body has a tear drop configuration. A narrow radial slit 15 extends through the angular extension 12 along the length of the body. Longitudinal slit 15 bisects the angular extension 12 and, along with flat faces 13 and 14, defines a pair of closely spaced apart adjacent parallel angularly and outwardly extending symmetrical mirror image tapered lips on opposite sides of the slit.

Body 10 is composed of semi-rigid resilient material so that abrasive sheet material 16 wrapped therearound, as shown in FIGS. 1 and 2, may be made to conform to arcuate surfaces of varying contours, such as commonly encountered on automobile bodies and similar finishing projects. As shown in FIG. 3, the abrasive sheet material 16 may alternatively be made to conform to the inner surface of passage 11 for sanding spindle-like structures. In either case the abrasive sheet material 16 is held gripped or clamped in slit 15 between the opposed tapered lips.

Body 10 may be formed from any of a variety of tough rugged synthetic resinous plastic or rubber or rubber-like materials. Exemplary materials are moldable and/or extrudable and include by way of example, polystyrenes and modified polystyrenes, ABS (acrylonitrile-butadiene-styrene) resin, polyvinyl chloride and copolymers thereof, natural rubber, and the like. These materials are formulated so as to be semi-rigid, that is, to be resilient enough to permit lateral flexing and some slight longitudinal deformation under normal manual working pressure. The materials are preferably formulated as closed cell foams so as to be buoyant in water. This facilitates use in wet sanding permitting easy release of accumulated sanded material from the abrasive surface and keeping the sander free from contamination by accumulated debris in the bottom of the water container. Dependent upon the material from which the body is formed, added strength and resilience may be imparted by embedding a C-cross-section spring steel member 12 in the body, as shown in FIG. 2.

Faces 13 and 14 defining the outer faces of the tapered lips intersect at an angle between about 60 and 90 degrees, and preferably between about 70 and 80 degrees. Thus, when the abrasive sheet material 16 is disposed on the outside of the sander body, it is possible to get into- corners, grooves and channels and like partially confined spaces.

The sander body is of a size to be easily held in the hand. Typically it may be about 1½ to 4 inches in diameter and 1½ to 8 inches in length with a wall thickness between about 3/16 to ½ inch. In use, sandpaper 16 or other abrasive sheet material is wrapped around the arcuate and flat outer surfaces of the body, as in FIGS. 1 and 2, or around the inner surface of passage 11, as in FIG. 3. In either event the free ends of the abrasive sheet material extend through and are gripped by slit 15.

The sandpaper is preferably first flexed by pulling the paper over a sharp edge one or more times with the grainy side up to permit the sandpaper to be put in place without cracking, splitting, etc. The body may be flexed to a wide variety of different contours appropriate to the surface being finished. The relatively flat surfaces provided by the outer faces 13 and 14 of the tapered lips may be used on flat surfaces.

Figure 4:
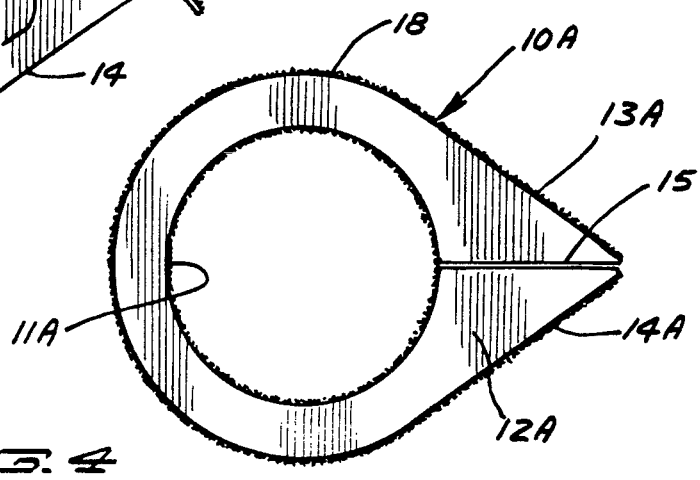
FIG. 4 is a similar end view showing an alternative form of sander in which abrasive grit is embedded in the face surfaces of the sander.

Instead of using sandpaper or other abrasive sheet material, as seen by reference to FIG. 4, the sander body 10A, which in all other material respects is identical to body 10, may have an adherent coating 18 containing abrasive particles applied to the outer surfaces of the sander body and/or the surface of passage 11.

Coating 18 is composed of a suitable rubber or rubber-like coating material having abrasive particles uniformly distributed throughout. Alternatively, the rubber or rubber-like material from which the sander body is formed may be compounded with abrasive particles uniformly distributed throughout the material prior to molding or extrusion. In either case, corundum, alumina, silica, and similar well known abrasives may be used in various particle sizes depending upon the particular sanding operation to be performed. Flexing of the body exposes the abrasive particles and as the softer rubber or rubber-like material wears away, more particles are exposed.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A hand-held sanding device which is laterally flexible and relatively inflexible longitudinally, capable of slight longitudinal deformation under normal manual working pressure, which device consists of:

A) a hollow generally tubular thick walled body of tough rugged semi-rigid resilient rubber or rubber-like material, said body being generally cylindrical through about three-fourths of its periphery in its normal relaxed at-rest state, and having a generally cylindrical generally closed passage throughout its length, B) an angular extension projecting from one side of said body, said extension being defined by a pair of flat outer intersecting tangential faces;

C) a longitudinal radial slit extending the length of said body from said generally cylindrical passage to the intersection of said tangential faces and bisecting the angular extension, the flat surfaces defining said slit being relatively wide extending from the outermost tip of said angular extension to the inner tubular wall of the body, said flat surfaces being parallel and closely spaced apart, adapted to grip a sheet of sandpaper or other abrasive sheet material therebetween, and D) a pair of closely spaced apart adjacent parallel angularly and outwardly extending symmetrical mirror image tapered lips on opposite sides of said slit and between said tangential faces.

2. A sanding device according to claim 1 wherein said body is adapted to engage the back surface of a sheet of sandpaper or other abrasive sheet material over its outer face, the free ends of said sheet material being grippable within said longitudinal slit.

3. A sanding device according to claim 1 wherein said body is adapted to engage the back surface of a sheet of sandpaper or other abrasive sheet material over its inner tubular surface, the free ends of said sheet material being grippable within said longitudinal slit.

4. A sanding device according to claim 1 wherein said body has abrasive grit embedded in at least its outer face and inner tubular surfaces.

5. A sanding device according to claim 4 wherein said body has abrasive grit distributed substantially uniformly throughout the body.

6. A sanding device according to claim 1 wherein said body has an elongated C-cross-section spring steel member embedded in the body wall between said lips.

7. A sanding device according to claim 1 wherein the outer tangential faces of said lips intersect at an angle between about 60 and 80 degrees.

8. A sanding device according to claim 7 wherein the faces of said tapered lips intersect at an angle between about 70 and 80 degrees.

9. A sanding device according to claim 1 wherein said sanding device is buoyant.

10. A hand-held sanding device which is laterally flexible and relatively inflexible longitudinally, capable of slight longitudinal deformation under normal manual working pressure, which device consists of:

A) a hollow generally tubular thick-walled body of tough rugged semi-rigid rubber or rubber-like material, 1) said body being generally cylindrical through about three-fourths of its periphery in its normal relaxed at-rest state, and having a generally cylindrical generally closed passage throughout its length, 2) said body being between about 1½ to 4 inches in diameter, and about 1½ to 8 inches in length, and 3) said wall thickness being between about 3/16 to ½ inch, B) an angular extension projecting from one side of said body, said extension being defined by a pair of flat outer tangential faces, C) a longitudinal radial slit extending the length of said body from said generally cylindrical passage to the intersection of said tangential faces and bisecting the angular extension, the flat surfaces defining said slit being relatively wide extending from the outermost tip of said angular extension to the inner tubular wall of the body, said flat surfaces being parallel and closely spaced apart, adapted to grip a sheet of sandpaper or other abrasive sheet material therebetween, and D) a pair of closely spaced apart adjacent parallel angularly and outwardly extending symmetrical mirror image tapered lips on opposite sides of said slit and between said tangential faces.

11. A sanding device according to claim 10 wherein the back surface of a sheet of sandpaper or other abrasive sheet material is in engagement with said body over its outer face, the free ends of said sheet material being gripped within said longitudinal slit.

12. A sanding device according to claim 10 wherein the back surface of a sheet of sandpaper or other abrasive material is in engagement with said body over its inner tubular surface, the free ends of said sheet material being gripped within said longitudinal slit.

13. A sanding device according to claim 10 wherein said body has abrasive grit embedded in at least its outer face and inner tubular surfaces.

14. A sanding device according to claim 13 wherein said body has abrasive grit distributed substantially uniformly throughout the body.

15. A sanding device according to claim 10 wherein said body has an elongated C-cross-section spring steel member embedded in the body wall between said lips.

16. A sanding device according to claim 10 wherein the outer tangential faces of said lips intersect at an angle between about 60 and 90 degrees.

17. A sanding device according to claim 16 wherein the faces of said tapered lips intersect at an angle between about 70 and 80 degrees.

18. A sanding device according to claim 10 wherein said sanding device is buoyant.

* * * * *